United States Patent [19]

Reed

[11] 4,157,239

[45] Jun. 5, 1979

[54] MOLECULAR SEAL IMPROVEMENT ACTION

[75] Inventor: Robert D. Reed, Tulsa, Okla.

[73] Assignee: John Zink Company, Tulsa, Okla.

[21] Appl. No.: 817,548

[22] Filed: Jul. 21, 1977

[51] Int. Cl.[2] ..... F23L 17/02

[52] U.S. Cl. ..... 431/202; 98/60

[58] Field of Search ..... 431/202, 5, 346; 98/58, 98/60; 126/312; 23/277 C

[56] References Cited

U.S. PATENT DOCUMENTS

| | | | |
|---|---|---|---|
| 3,662,669 | 5/1972 | Cullinane | 431/202 X |
| 3,898,040 | 8/1975 | Tabak | 431/5 X |

*Primary Examiner*—Edward G. Favors

*Attorney, Agent, or Firm*—Head, Johnson & Chafin

[57] ABSTRACT

This invention is an improvement over the conventional molecular seal, used for the purpose of preventing the reverse flow of air into the top of a flare stack system upon cessation of flow of the lighter-than-air waste or dump combustible gases. A cylindrical chamber or housing surrounds vertical pipe sections which are parts of the flare stack system. The cylindrical housing is of significantly larger diameter than the flare stack and is closed at the top between the housing and the flare stack. A vertical pipe projects through and downwardly below the upper closure of the housing. Below the bottom of the vertical pipe inside of the housing, is a bulkhead containing a plurality of circular openings near its outer perimeter, into which a plurality of pipes have been welded, which extend upwardly in the annulus between the vertical pipe and the outer housing. These pipes terminate at a selected distance below the top closure of the housing. The bottom end of the housing is closed with a plate and an inlet pipe is welded in the center of the closure plate.

1 Claim, 2 Drawing Figures

MOLECULAR SEAL IMPROVEMENT ACTION

FIELD OF THE INVENTION

This invention lies in the field of combustion of waste or dump gases in flare stacks. More particularly, it concerns means for preventing the downward movement, beyond a selected point, of atmospheric air, into the flare stack system when the flow of lighter-than-air combustible gases is terminated.

DESCRIPTION OF THE PRIOR ART

In carrying out some industrial processes, gases, such as hydrogen and light hydrocarbons and other gases, are produced. These gases are customarily employed for useful purposes, but, on occasion or as a result of some emergency, it is necessary to vent such gases to the atmosphere. These dump gases are delivered into the lower portion of a vertically disposed flare stack, so that the gases ultimately are released at a significant elevation above the surrounding terrain. Such gases are burned at the upper end of the stack, as is well known in the art.

These dump gases are in general lighter-than-air and have a molecular weight of 28 or less. Many of the gases, upon limited mixture with air, form explosive mixtures. It is, therefore, important to avoid the presence of air below a limited upper portion of the flare stack system to avoid conditions which might promote explosions.

In the prior art it has been customary to inject, at the base of the stack, a constant but limited flow of lighter-than-air purge or sweep gases to make sure that there is always flow of gases within the system and toward the burning point of the flare when minor temperature change occurs within the flare. In this invention such additional flow of gas injection is optional, except for major temperature change in the gas content of the flare, when separate means such as U.S. Pat. No. 3,741,713 can be adopted to compensate for gas temperature within the flare system.

SUMMARY OF THE INVENTION

These and other objects are realized and the limitations of the prior art are overcome in this invention by providing a molecular weight created trap in the flare stack near the top thereof, wherein the normal flow of dump gases is upwardly in the flare stack to the bottom of a cylindrical housing of larger diameter than the flare stack. This housing is closed off at the bottom by an annular plate between the bottom end of the cylindrical housing and an entry tube for flared gases, and is closed off at the top with an annular plate to the outer surface of the tubular continuation of the flare stack up to the top thereof, where the gases are burned. The upper portion of the flare stack extends downwardly as a vertical pipe, into the housing, a selected distance.

At a selected distance below the bottom of the vertical pipe is a tightly welded bulkhead across the housing, having a plurality of circular openings arranged near the outer perimeter, with pipes welded into those openings. The pipes extend upwardly of the bulkhead in the annular space between the vertical pipe and the outer wall of the housing, to a selected distance below the top of the housing. At a selected distance further below the bulkhead a plenum is formed between the bulkhead and a bottom closure for the housing. The dump gases flow upwardly in the lower portion of the flare stack, into the plenum within the housing below the bulkhead via a tube which pierces the bottom closure, thence up through the plurality of pipes and out the top thereof. They then flow downwardly in the annular space between the vertical pipe and the outer housing, and down to a point below the bottom of the vertical pipe and up into the flare stack to the top thereof.

Venting-bound gases, driven by greater source pressure than atmospheric pressure, enter through the bottom end of the housing into the plenum thence, radially, to entry to the plurality of separate and vertically oriented pipes, thence upwardly in each of the vertically oriented pipes to a point just below, but close to the closed top of the housing. At the tops of the separate and vertically oriented pipes, the gases are released to the plenum which is formed between the downwardly projecting vertical pipe into the housing and the outer walls of the housing. Continued gas flow is downwardly in the plenum to a point which will permit gas flow into and upwardly in the downwardly projecting vertical pipe to the flare for release to atmospheric pressure. Gas flow, in transit through our device, makes a first 90 degree turn, then a second 90 degree turn into the vertically oriented pipes, followed by two 180 degree turns from entry to exit.

When gas is actively flowing from entry to exit, there is no danger of air entry to any part of the flare system, but when the gas flow stops and when the gas masses reach a static condition, there is gas-buoyancy-induced danger of air entry to the flare system because the buoyancy of the gases within the vertical portion of the flare system would cause them to "decant" to atmosphere for replacement with air, and this action is accelerated by wind action which is virtually continuous at flare elevations above grade level. For this reason, presence of air in the downwardly projecting vertical pipe which is in open communication with the atmosphere at the top of the flare is ultimately inevitable, and this air presence is not dangerous as has been operationally proven many times. But any further progress of air toward and into the system can be dangerous according to the degree of such progress, but minor air entry can be tolerated.

Buoyancy of gases at molecular weights less than 28.966 (air) provides means for prevention of air entry. Due to their buoyancy, such gases, as confined within a chamber, create greater than atmospheric pressure at the top of the chamber, while the pressure at the bottom is atmospheric pressure, while at intermediate points up the chamber, the pressure is increasingly greater than atmospheric pressure due to the buoyancy effect. Gases move from higher to lower pressure. The downwardly projecting vertical pipe within the housing has its end above the bulkhead. Therefore, the pressure there is greater than atmospheric, and air as it moves into the downwardly projecting vertical pipe into the chamber cannot move beyond the pipe because it, at atmospheric pressure, cannot move to a zone of higher pressure.

If the gas temperature within the flare system could remain constant, the buoyancy pressure-created pressure barrier thus created would prevent any air entry to the system, but because change of temperature occurs, the volume of gases within the system will vary as the absolute temperature ratio. If the temperature is increased, the volume of contained gases at constant pressure is increased to cause gas movement out of the flare, but if the temperature of the gases is decreased, the opposite occurs, and air is drawn from atmosphere at the flare discharge point in a reversed direction into the flare system. The effectiveness of the air entry protective device can, therefore, be said to vary according to its contained volume; also the deviousness of the flow path through it as path deviousness compels volume increase for the air protective device which is used. Prior art, such as U.S. Pat. Nos. 3,055,417 and 3,289,709 and 3,662,669 is of interest. In these, no 90 degree gas flow turns are used, and only two 180 degree turns suffice for flow path completion. This is adequate for static flow and unchanged temperature condition within the flare system, but because of minimal contained gas volume, all require the use of constant purge gas entry to the system to avoid air indraft in small temperature decrease. Typical purge gas is methane or natural gas which, in flare burning, represents fuel energy wastage.

Invention here shown makes use of purge gas optional rather than required, because the contained volume is greatly increased because of housing diameter increase to permit use of the bulkhead into which plural vertically extended tubes are welded in order to convey/contain gases enroute from entry, after two 90 degree turns to the top of the chamber where two 180 degree turns within the chamber, plus downward movement, convey gases to an exit means toward the atmosphere. Note here that gases within the plural vertically extended pipes are also "contained" within the chamber since the pipes are also contained within the chamber. Height of the chamber is a selected dimension which must be minimal to avoid excessive weight and cost. Note also that the volume of the plenum which first receives vented flared gases adds materially to the contained volume within the chamber which is top and bottom enclosed to form the chamber with the surrounding housing tube.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
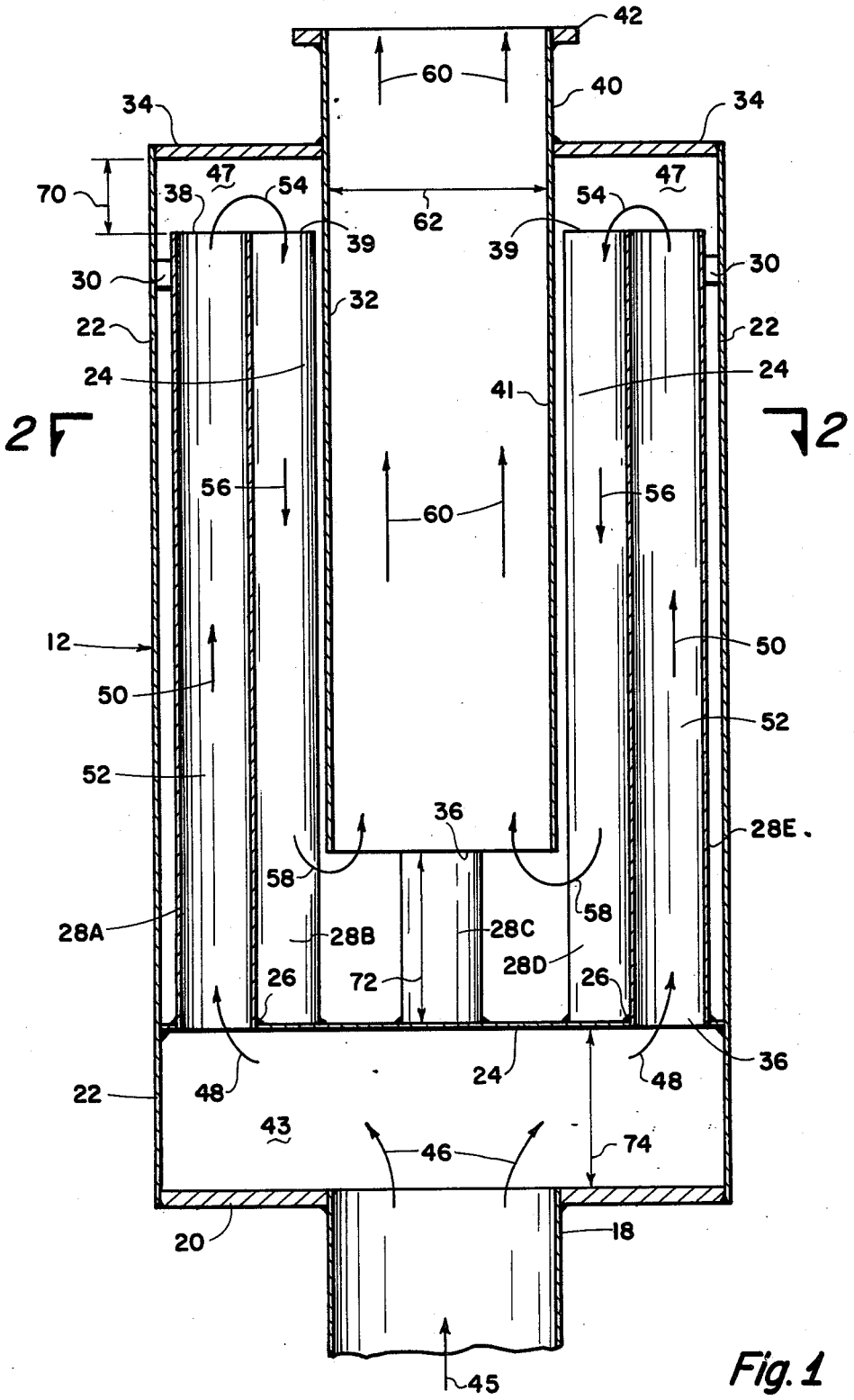
FIG. 1 represents in section one embodiment of this invention.

Referring now to the drawings, there is shown one embodiment of this invention indicated generally by the numeral 12. This consists of an assembly which is inserted into the flare stack at a point near its top. Not shown, but well known in the art, is the upward extension of the flare stack to a selected elevation above the plane 42, to the top of the flare stack, where an ignition flame is provided, etc., as is well known in the art.

The assembly 12 consists of an outer cylindrical housing 22, which is closed at the top between the housing and the vertical pipe 41, which is a downward extension of the flare stack 40, by an annular plate 34 which is attached as by welding. Similarly, the bottom end of the housing is closed by an annular plate 20 between the housing 22 and a pipe 18 which is of substantially the same diameter as the flare stack 40. The flare stack 40 extends downwardly as vertical pipe 41 to a selected depth, terminating at the bottom end 36.

At a selected depth 72 below the bottom 36 of the vertical pipe 41 is a bulkhead 24 having a plurality of circular openings 36 into which pipes 28 are welded. The pipes 28 extend upwardly from the bulkhead 24 to a distance 70 below the top 34 of the housing.

There is a plenum 43 within the housing 22 below the bulkhead 24 and the bottom closure plate 20.

Normally, waste gases, or dump gases, flow in accordance with arrow 45 up through the pipe 18, from a source not shown, into the plenum 43, as arrows 46, and then through the plurality of pipes 28, in accordance with arrows 48 and 50 to the plenum 47 above the tops of the pipes 28, which extends throughout the annular space between the tops 38 of the pipes 28 and the top plate 34.

Figure 2:
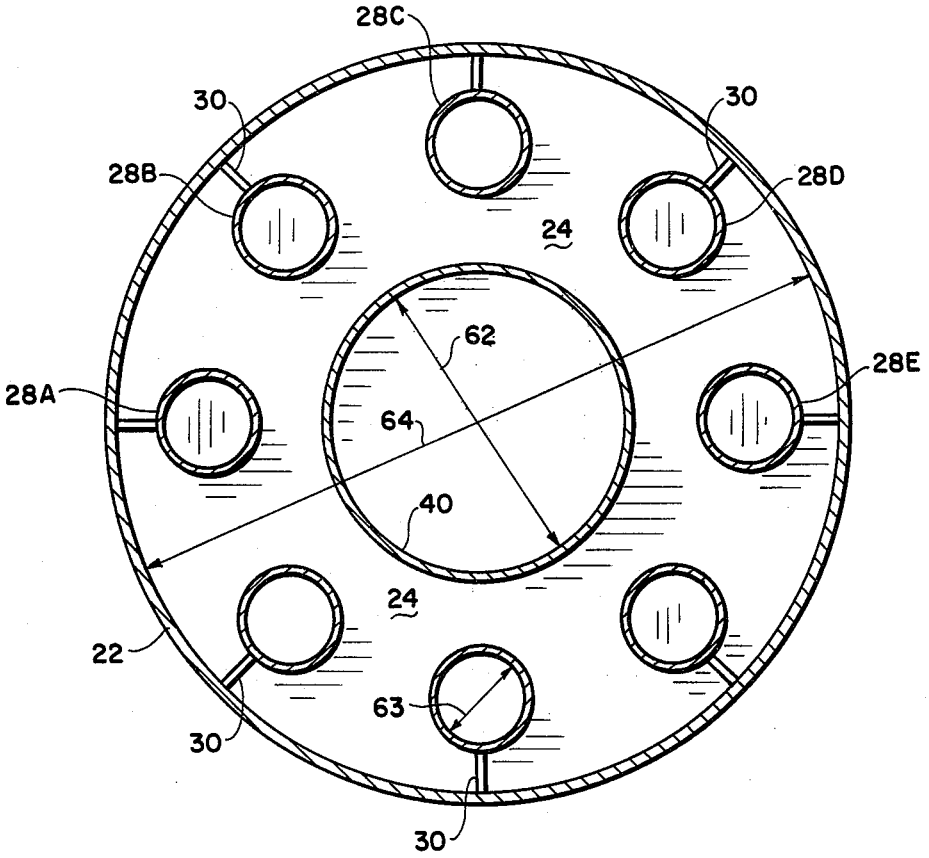
FIG. 2 illustrates a view of FIG. 1 taken across the plane 2—2.

The gas flows up the pipes 28, follows arrows 54, and flows downwardly through the annular space between the outer housing and the vertical pipe 41 which is plenum 24 of FIG. 2, in accordance with arrows 56, then upwardly into the bottom end of the vertical pipe 41 in accordance with arrows 58. The flow then continues in accordance with arrow 60 up through the vertical pipe 41 to the flare stack 40, and up to the top thereof for discharge.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. In a flare stack system for combustion of waste gases, an improved molecular seal, for installation at an intermediate point in the flare stack system, comprising;

(a) a cylindrical housing of significantly larger diameter than said flare stack, said housing closed by annular plates to the flare stack at the top and at the bottom, a vertical pipe of the same diameter as the flare stack extends downwardly a first selected depth into said housing creating an annular space therebetween;

(b) at a second selected depth below the bottom of said vertical pipe a bulkhead extends across and seals the complete cross-section of said housing creating a plenum between said bottom annular plate and said bulkhead;

(c) a plurality of openings in said bulkhead near the outer perimeter thereof, each opening having a vertical welded tube therein, said tubes extending upwardly into said annular space to within a third selected distance of the top annular plate of said housing;

the dimension of the contained volume of the cylindrical housing less the volume of said vertical pipe and the total volume of said vertical tubes being greater than the total volume of said vertical tubes, whereby said waste gases flow up said stack into said plenum, up through said vertical tubes into said annular space, thence down through said annular space, thence upwardly through said vertical pipe to said stack.

* * * * *